United States Patent [19]

Maddock

[11] Patent Number: 4,588,392

[45] Date of Patent: May 13, 1986

[54] METHOD OF FORMING A THERMOPLASTIC FILM SACK HAVING A STRESS RELIEVED BOTTOM GUSSET SEAL LINE

[75] Inventor: Robert T. Maddock, W. Rush, N.Y.

[73] Assignee: Mobil Oil Corporation, New York, N.Y.

[21] Appl. No.: 725,975

[22] Filed: Apr. 22, 1985

Related U.S. Application Data

[62] Division of Ser. No. 584,836, Feb. 29, 1984.

[51] Int. Cl.[4] ..... B31B 1/64

[52] U.S. Cl. ..... 493/200; 383/903; 493/226; 493/232; 493/267; 493/926

[58] Field of Search ..... 493/189, 195, 200, 224, 493/229, 232, 237, 223, 373, 378, 248, 246, 231; 383/120, 903

[56] References Cited

U.S. PATENT DOCUMENTS 3,485,437 12/1969 Gruentzel et al. ..... 383/903
4,165,832 8/1979 Kuklies et al. ..... 383/903

FOREIGN PATENT DOCUMENTS 1231686 5/1971 United Kingdom ..... 383/903

*Primary Examiner*—Francis S. Husar
*Assistant Examiner*—Robert Showalter
*Attorney, Agent, or Firm*—McKillop Alexander J.; Michael G. Gilman; James P. O'Sullivan

[57] ABSTRACT

A plastic film sack having gussetted side walls, and in the bottom of said sack, a heat-seal stripe welding together the four film layers in the gusseted regions of the sack and a heat seal stripe welding together the two film layers between said gusseted regions; and between the heat-seal stripes of the four film layers and the heat-seal stripe of the two film layers are unsealed, arcuate stress-relief regions and the method of forming the same.

3 Claims, 3 Drawing Figures

PRESENT INVENTION

PRIOR ART
FIG. 1
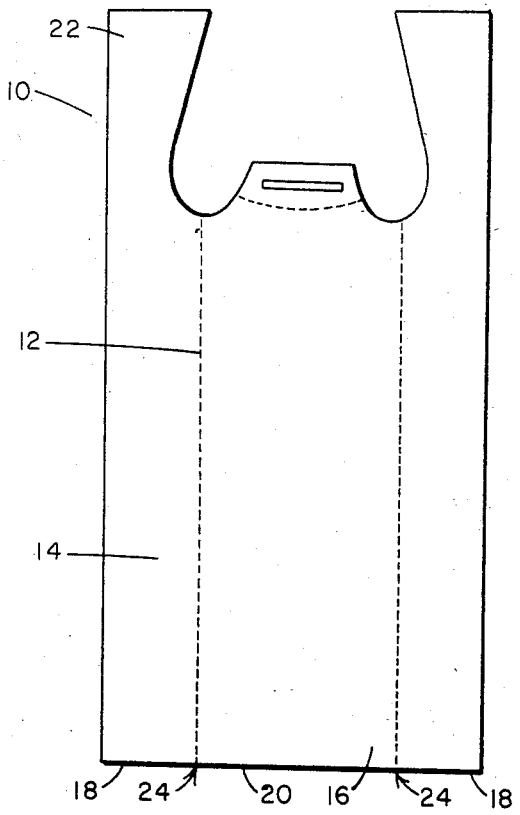
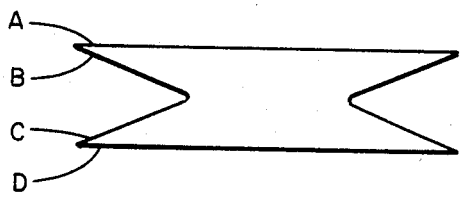
FIG. 2
FIG. 3
PRESENT INVENTION
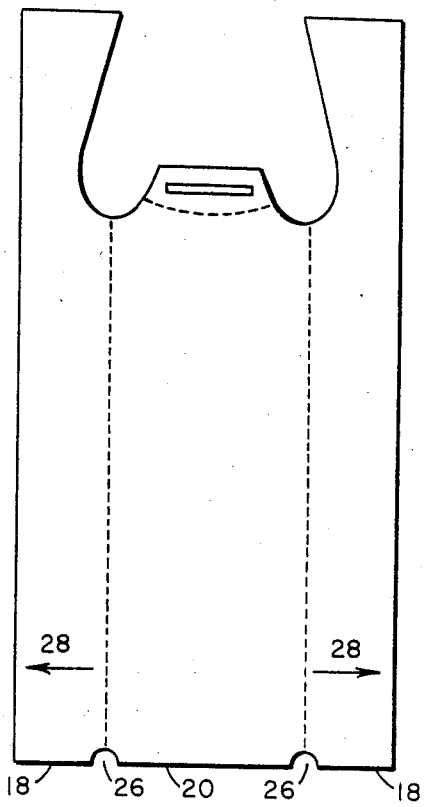

METHOD OF FORMING A THERMOPLASTIC FILM SACK HAVING A STRESS RELIEVED BOTTOM GUSSET SEAL LINE

This is a division of copending application Ser. No. 584,836, filed Feb. 29, 1984.

The present invention relates to a handled thermoplastic bag structure and a method for forming the same.

In recent years plastic bags and sacks have appeared in increasing numbers in competition with paper bags and sacks. The many advantages plastic film sacks have over paper sacks will ultimately be responsible for the same dominating the field of bags and sacks. Features such as high tear strength, waterproof characteristics, strong integral handles, puncture resistance, high film density, cost competitiveness, etc. will make thermoplastic sacks the article of choice, particularly, in the field of grocery sacks.

The structure of thermoplastic grocery sacks has in recent years evolved to that of a structure made from: collapsing a tube of plastic so as to have two in-folded pleats or gussets at opposite sides thereof; forming two spaced seals positioned trasverse of the collapsed tube; and removing from one end thereof of a U-shaped segment which simultaneously forms two integral handles and a bag mouth opening. By this configuration and by virtue of the in-folded pleats or gussets the handles have double film thicknesses which give greater carrying strength in the handles. A forerunner of this bag has been referred to as a "undershirt" type bag, since the upper portion of the bag and handles resembles an undershirt.

Bags of these structures had a tendency to split or tear in the bag mouth opening as handles were stretched during the bag loading process. This problem was successfully solved by including stress relief structures in the bag mouth opening in the region near the base of the handles; see U.S. Pat. No. 4,165,832, the disclosure of which is, in its entirety, incorporated herein by reference.

With the increasing use of such thermoplastic handled sacks in conjunction with the down-gauging trend regarding the thickness of the thermoplastic film employed therein, a problem has developed which threatens to undermine the consumer's confidence in such thermoplastic sacks. At the bottom of the above-described sacks, a heat seal stripe forms a welded closure for the bag structure. In the region of the in-folded pleat or gusset, four layers of film are brought together in the outer regions of the lay-flat bag structure and, in-between, two layers of the front and back panels of the sack are brought together. Thus, the heat seal must simultaneously weld four layers together in the outer segments of the sack and two layers together at the central region of the sack. It has been found that bags have been failing by tearing open in the region of the four and/or two film heat seal portion of the bottom of the sack beginning at the seal transition from the four layers to the two layers.

It is an object of the present invention to overcome this problem.

SUMMARY OF THE INVENTION

The present invention is concerned with a plastic film sack having gusseted side walls and in the bottom of said sack, a heat-seal stripe welding together the four film layers in the gusseted regions of the sack and a heat seal stripe welding together the two film layers between said gusseted regions; and between the heat-seal stripes of the four film layers and the heat seal stripe of the two film layers are unsealed, arcuate stress relief regions.

Stated otherwise, in a plastic film sack having gusseted side walls and a heat-sealed bottom stripe welding together four film layers in the outer region of the bag bottom and two film layers in the center region of the bag bottom, the improvement comprising: the provision of stress-relief structures in the bottom of said sack, said structures having the following characteristics:

(a) they at least correspond to the shape remaining in said sack from two cut-away regions located as spaced interruptions in, and extending above, the line of the heat-sealed bottom stripe;

(b) they are located so as to prevent the formation of, or eliminate preformed, heat-seal junctures at each gusset at its point of maximum in-folding and the bottom of the sack; and (c) said shape is at least generally arcuate or forms part of a circle so as to constitute stress relief arcs or curves extending from a four film seal point to a two film seal point in said heat sealed bottom stripe.

In a more particular form of the present invention, the sack of thermoplastic film comprises: front and rear bag walls joined together by side walls, each side wall having a single integral pleat; an open mouth top portion having double film thickness handles which are integral extensions of said front, rear and side walls; at least one bottom heat-seal stripe welding together four film layers in both of the collapsed, lay-flat regions of said side walls and welding together the two bottom-central film layers of said front and rear walls; and between the heat-seal stripes of the four film layers and the two film layers are unsealed, arcuate stress relief regions.

The method of forming the above described sacks comprises collapsing a tube of thermoplastic film while simultaneously forming gussets in opposite sides thereof and prior to or subsequent to forming the heat-seal stripe or stripes for the bottom of the bag, removing the film area below a curve extending from a point at the bottom of the four film layers of said structure to a point at the bottom of the two film layers of said structure. If the film removal is accomplished prior to heat sealing the bottom of the bag then thereafter heat seals are formed in the four layer region and in the two layer region of the bottom of the bag.

BRIEF DESCRIPTION OF THE DRAWINGS

FIG. 1 is a front elevation view representing a sack of the prior art.

FIG. 2 is an end view of a thermoplastic tube having oppositely disposed gussets in partially collapsed form.

FIG. 3 is a front elevation view of one form of the bag structure of the present invention.

DETAILED DESCRIPTION OF THE INVENTION

Referring to FIG. 1, 10 refers to a bag structure of the prior art. In forming this bag structure, a collapsed tubular thermoplastic film such as that depicted in FIG. 2 is employed. FIG. 2 shows an end view of such a tube having two oppositely disposed in-folded gussets represented by B and C. The front and the rear of the bag derive from film A and film D of the collapsed tubular structure. The dotted line 12 of FIG. 1, illustrates the extent to which the gusset or pleat extends in from the side region of bag 10. In its fully lay-flat condition the outer segments of the bag constitute four layers of film, for example, in the region 14. These four layers are shown in FIG. 2 as layers A, B, C and D. The same is true on the opposite side of the bag. The region 16 in FIG. 1 represents the central region of the sack made up of two films, i.e. film A and D of FIG. 2. The region 18 of FIG. 1 represents a heat seal which extends in a line or stripe across the bottom of the sack. At the opposite end of the sack, 22 represents the handles which are made of two separate film thicknesses by virtue of the gusset or pleat arrangement of the sack.

The two points 24 of FIG. 1 represent, an inherent weak spot in the heat-seal bond at the bottom of the bag. When the arrangement shown in FIG. 2 is completely collapsed, films A, B, C, and D, are essentially parallel. Thereafter, a sealing means heat unitizes the layers. The melt-unitized mass in the outer regions of the bottom of the bag is thicker than that in the center region of the bag. When the bag is put to use and product begins filling the bag, the gussets or pleats 12 begin to unfold in an attempt to form the side walls of the sack. This readily occurs unimpeded from the mouth of the sack and throughout most of the bag. However, the bottom of the gusset 12 is prevented from expanding because it has been heat sealed between films A and D. As filling and stretching of the bag continues, the resistance at points 24 can be exceeded. This is particularly true in bags made of high molecular weight, high density polyethylene of a film gauge thickness between about 0.3 to about 1.0 mils. A tear develops in the thickness region corresponding to films A and D, just adjacent to the transition region extending from the fused four layers to the fused two layers at the bottom of the bag. Once such a tear begins, a zippering effect can cause the bottom of the bag. to open with loss or partial loss of the contents thereof.

Referring to FIG. 3, it has been found that if the strain or stress that becomes concentrated at region 24 of FIG. 1, can be relieved or transferred elsewhere, the normal fuse-bond strength of combined films A and D can withstand the forces of loads for which the bag structure has been designed. It has been found that, either by removal of the above-mentioned transition region or prevention of the formation of this transition region and the provision of a more or less arcuate stress relief structure in place thereof, the above-mentioned problem is successfully avoided. Thus, if a stress relief region, depicted at 26 in FIG. 3, is fashioned into the bottom of the bag, the problem is avoided. Numeral 26 generally refers to a half circular cut-out region extending between the four layer film arrangement at the left hand side of the bag, to the two layered film arrangement at the central bottom region of the bag. Similarly, from the right-hand region of the four layers of film, a stress relief structure extends to the two layer arrangement at the central bottom region of the bag. An extension of the gusset line 12 would appear to bisect the stress relief structure shown in FIG. 3. This arrangement is not critical and the stress relief structure can be somewhat to the left or right of this line. If this cutout region is accomplished prior to the sealing of the bottom of the bag, then thereafter, seals 18 and 20 must be put in the bottom of the bag. The layers of film in the arcuate region of the stress relief structure are not sealed. This permits a small portion of the gusset adjacent to the stress relief structure 26 to expand a short distance in the direction of arrows 28. This, in conjunction with a better distribution of forces throughout the bottom of the front and rear panels by virtue of the stress relief structure at least significantly alleviates the tearing and zippering problem.

The contemplated stress relief structures of the present invention appears to best function when they assume the shape of an arc or some part of a circle. In a bag having a bottom dimension of approximately 12 inches, a stress relief structure providing a seal-line gap of approximately $\frac{3}{8}$ to 1 inch is contemplated and this gap can extend vertically in the direction of the bag mouth opening a distance of from $\frac{1}{8}$ to $\frac{3}{4}$ of an inch. Half circles ranging from the diameter of a ten cent piece to a five cent piece has been found to be satisfactory.

While the contemplated sacks can be made of any thermoplastic material, polyethylene and polyethylene blends are preferred. The term polyethylene is employed herein in its generic sense to include low density polyethylene (LDPE) having a density of from about 0.910–0.939, linear low density polyethylene (LLDPE), which actually is a copolymer of ethylene and another alpha olefin, having a density ranging from about 0.910–0.939, high molecular weight, high density polyethylene (HDPE) having a density ranging from about 0.940–0.970 and any blends thereof. A preferred material for handled grocery sacks is a blend of LLDPE and LDPE with the latter being present in from about 0–20% by weight. When employing this material, the film gauge can range downward to from 0.3 to 1 mil in thickness. Another preferred polyethylene resin is high density polyethylene (HDPE) alone or in combination with from 0 to 50 weight % of LLDPE. A preferred combination is a blend of the two which would yield a density of from 0.945–0.955 g/cc. When material of this density is employed unusually strong film having a guage thickness of from 0.3 to 1 mil can be employed in forming the grocery sacks contemplated by the present invention.

What is claimed is:

1. In a process for forming a thermoplastic film sack comprising:

(a) forming two oppositely disposed gussets in a thermoplastic tube, (b) collapsing said tube, (c) sealing one end of said tube transverse to said gussets, and (d) removing an end region of the sealed end of said tube so as to form an open mouth portion and integral handles;

the improvement comprising, a bottom seal transverse to said gussets, removing the film area below a curve extending from a point at the bottom of the four film layers of each gusset region to a point at the bottom of the two film layers of said sack so as to provide a plurality relief regions therein.

2. The process of claim 1 wherein said film area is removed prior to the formation of said bottom seal.

3. The process of claim 1 wherein said film area is removed after the formation of said bottom seal.

* * * * *